United States Patent [19]

Mülder et al.

[11] Patent Number: 4,504,356

[45] Date of Patent: Mar. 12, 1985

[54] CONTINUOUS PROCESS OF REMOVING SILICA FROM SPENT PULPING LIQUORS

[75] Inventors: Jürgen Mülder, Mühlheim; Pedro Gutmann, Kronberg, both of Fed. Rep. of Germany

[73] Assignee: Metallgesellschaft Aktiengesellschaft, Frankfurt am Main, Fed. Rep. of Germany

[21] Appl. No.: 470,854

[22] Filed: Feb. 28, 1983

[30] Foreign Application Priority Data

Jun. 3, 1982 [DE] Fed. Rep. of Germany ..... 3208200

[51] Int. Cl.[3] ..... D21C 11/04; D21C 5/00; C02F 1/60

[52] U.S. Cl. ..... 162/29; 162/30.1; 162/30.11; 162/32; 210/710; 210/769; 210/928; 423/DIG. 3

[58] Field of Search ..... 162/29, 30.1, 30.11, 162/32, 80, 94, 96; 423/DIG. 3; 210/710, 711, 769, 772, 928

[56] References Cited

U.S. PATENT DOCUMENTS 4,331,507 5/1982 Roberts ..... 162/29

FOREIGN PATENT DOCUMENTS 3003090 8/1981 Fed. Rep. of Germany .
81705 7/1978 Japan ..... 162/29
103387 8/1980 Japan ..... 162/30.1

OTHER PUBLICATIONS

Chemical Abstracts, vol. 89, 1978, No. 61292.
Institute of Paper Chemistry Abstract Bulletins, vol. 54, 1983, No. 6347; vol. 48, 1978, Nos. 6735 and 9335; vol. 31, 1961, No. 331; vol. 53, 1982, No. 11933.

*Primary Examiner*—William F. Smith
*Assistant Examiner*—K. M. Hastings
*Attorney, Agent, or Firm*—Sprung Horn Kramer & Woods

[57] ABSTRACT

A continuous process of removing silica from spent pulping liquors (black liquors) which have been obtained by the alkaline digestion of annual plants. The spent liquor is preconcentrated and contacted with a $CO_2$-containing gas. The $CO_2$-containing gas is supplied at a rate of 30 to 40 $m^3$ s.t.p. per $m^3$ of spent liquor. The precipitated silica is removed from the treated liquor. The silica-containing precipitate which has been separated is diluted and washed with water and causticized by an addition of lime or milk of lime. Solid and liquid phases are separated from each other and the resulting residue is combusted.

15 Claims, 1 Drawing Figure

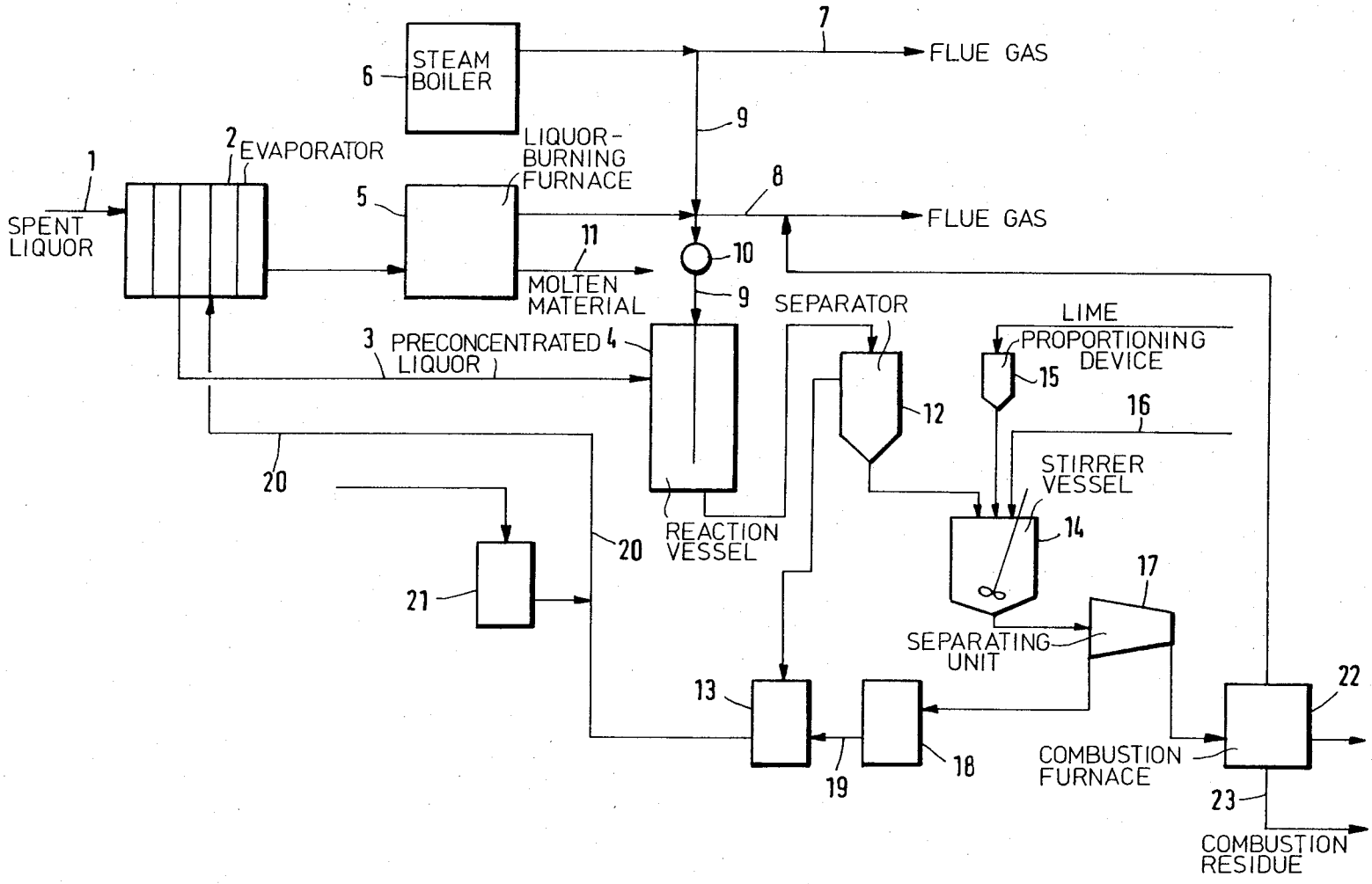
SPENT LIQUOR
1
EVAPORATOR
2
PRECONCENTRATED LIQUOR
3
REACTION VESSEL
4
LIQUOR-BURNING FURNACE
5
STEAM BOILER
6
FLUE GAS
7
8
9
10
MOLTEN MATERIAL
11
SEPARATOR
12
13
SEPARATING UNIT
14
STIRRER VESSEL
15
LIME PROPORTIONING DEVICE
16
17
COMBUSTION FURNACE
18
19
20
21
22
23
COMBUSTION RESIDUE

CONTINUOUS PROCESS OF REMOVING SILICA FROM SPENT PULPING LIQUORS

This invention relates to a continuous process of removing silica from spent pulping liquors (black liquors) which have been obtained by the alkaline digestion of annual plants, such as bamboo, bagasse, reed and straw, wherein said liquor is treated with $CO_2$-containing gases and the precipitated silica is separated.

It is known that for a removal of silica from silica-containing alkaline spent pulping liquors obtained in processing grasses, such as straw, bamboo, reed, etc., carbon dioxide may be introduced into the black liquor and the resulting silica gel may be transformed by heating under pressure to crystalline solids, which are filterable and which are subsequently separated from the liquor (German No. 522,730).

In another known process, dissolved silica is removed from alkaline spent pulping liquors by precipitating the silica by means of lime at the boiling point and with stirring. Before the treatment, the liquor is concentrated to a solids content of about 30% and quicklime is subsequently added to the liquor, which is boiling and the mass is stirred. After a short reaction time the liquor is separated in known manner from the sludge which has been formed by the reaction (German Patent Specification No. 1,046,465).

Another known process is carried out in two steps. In the first step, the spent liquor is treated with carbon dioxide until a predetermined pH value has been reached, at least about 75% of the silica content of the spent liquor is precipitated, and the precipitated silica is separated. When part of the silica has been removed from the liquor in the first step, the liquor is treated in the second step with milk of lime in such a manner that calcium silicate is precipitated and silica can be removed to the desired degree by a precipitation and removal of calcium silicate (German Offenlegungschrift No. 30 03 090).

These known processes are complicated in part and the precipitating equipment which is used does not always remove silica to the desired degree.

If scrubbers or ejectors are used to precipitate $SiO_2$, flue gases having high $CO_2$ contents are required at very high rates. The use of gases at high rates results in an undesired, strong foaming during the treatment of the liquor. The use of packed absorption towers for long periods also causes problems because the packing is very quickly contaminated by precipitate and must be periodically washed.

Whereas silica can be removed to a similar degree by a treatment with lime, that process is expensive because much lime is consumed and the losses of organic and alkaline substances are relatively high too. A considerable quantity of sludge is formed. No information is available on an ecologically satisfactory treatment of the waste sludge or on the utilization of such sludge.

It is an object of the invention to provide a process which avoids these and other disadvantages of the prior art. It is a further object to provide a process by which silica can be removed to the highest possible degree and in a simple and economical manner from spent pulping liquors, such as are formed by the alkaline digestion of annual plants, particularly such liquors having a high silica content. It is a still further object to provide a process which does not result in pollution and provide a silicate-containing waste product which is readily disposable and suitable for utilization in other industries, if desired.

SUMMARY OF INVENTION

This object is accomplished according to the invention in that the spent liquor is preconcentrated and is contacted with $CO_2$-containing gases, which are supplied at a rate of 30 to 40 $m^3$ s.t.p. per $m^3$ of spent liquor, the precipitated silica is removed from the treated liquor, the silica-containing precipitates which have been separated are diluted and washed with water and are causticized by an addition of lime, solid and liquid phases are separated from each other and the resulting residue is burnt out to obtain, if desired, a molten material, which is cooled and then granulated.

The $CO_2$-containing gas preferably comprises a flue gas. The use of a flue gas affords the advantage that it is inexpensive and becomes available in the same process. The $CO_2$-content may be very low in amount, e.g., to less than 5% by volume.

In accordance with the invention the spent liquor which is to be treated is suitably preconcentrated to a solids content of 8 to 30% by weight, preferably 12 to 25% by weight.

Within the scope of the invention the spent liquor which has been preconcentrated is contacted with the $CO_2$-containing gases in a jacket-heated reaction vessel by means of a pipe bend aerator. This results in a particularly intense mass transfer. It is preferred in the practice of the invention to intensely contact the pre-concentrated liquor with $CO_2$.

The precipitate formed by the treatment with the $CO_2$-containing gases can be separated from the spent liquor by sedimentation or centrifuging.

According to a preferred further feature of the invention the silica-containing precipitate which has been separated is diluted and washed with water at a ratio of 1:4 to 1:1 by volume, depending on the intended further processing. Quicklime or milk of lime is added to the washing water in a proportion which is sufficient for transforming the sodium carbonate content of the precipitate into sodium hydroxide by a causticizing reaction.

According to a further preferred feature of the invention, the filtrate obtained by the filtration of the washed precipitate is combined with the spent liquor from which the silica has been removed and the resulting mixture is recycled to the preconcentrating means.

Within the scope of the invention, organic compounds which are still contained in the precipitate which has been separated can be removed by being burnt. The supply of heat can be increased to such a rate, if desired, that the precipitate leaves the combustion furnace in a molten state. That molten material is then cooled in an air stream and is ground to form granules having a desired particle size, e.g., by means of a mill provided with a sieve. The resulting precipitate can be disposed of in an ecologically satisfactory manner or can be re-used.

Additional sodium hydroxide solution can be added in a controlled proportion to the resulting liquor for a control of the viscosity of the thick liquor formed by the evaporation.

Within the scope of the invention, such proportions of $Na_2O$, $SiO_2$ and CaO are desirably adJusted during the washing of the precipitate and the causticization of the sodium carbonate content that a eutectic mixture having the lowest possible melting point is obtained.

The advantages afforded by the invention reside particularly in that a simple, continuous process has been provided by which silica can be removed to a residual content of 0.2 to 0.4 grams per liter from spent pulping liquors obtained by the alkaline digestion of annual plants, such as bamboo, bagasse, reed, straw. Because the melting point of the separated precipitates is adjusted to a low value, said precipitates can be melted in conventional furnaces fired with coal, gas or oil.

The process is highly economical because no extraneous chemicals other than lime in small quantities, e.g., in the form of quicklime or milk of lime, are required. The flue gas which become available at no cost in the same process can be used to remove silica. The process is ecologically satisfactory.

Another advantage resides in that after the removal of silica, the black liquor can be concentrated in an indirect evaporator to a solids content of 60 to 65% which is sufficient for a combustion. That solids concentration sufficient for a combustion is thus obtained without a need for a subsequent evaporation, e.g., by a direct contact of the liquor with flue gas in a cyclone or cascade evaporator.

BRIEF DESCRIPTION OF DRAWING

The invention is shown diagrammatically and by way of example in the appended drawing and is now described in detail below.

DESCRIPTION OF SPECIFIC EMBODIMENT

A supply of spent pulping liquor (black liquor) at 1, is passed to an evaporator 2, from which a preconcentrated spent liquor 3 is withdrawn. The preconcentrated liquor is passed to reaction vessel 4 and therein contacted intensely with $CO_2$-containing gases (flue gas).

A liquor-burning furnace 5 receives material from evaporator 2. A steam boiler 6, is in fluid communication with flue 7. Flue 8 is in fluid communication with liquor burning furnace 5. A duct 9 for feeding flue gas to the reaction vessel 4 is provided with a blower 10.

Molten material is withdrawn from liquor burning furnace 5 at 11 while a unit 12 consisting of a separator (centrifuge) or of a sedimentation hopper in combination with a centrifuge is provided to receive the reaction product of reaction vessel 4.

An intermediate vessel 13 collects filtrate (black liquor from which silica has been removed) while a stirred vessel 14 receives the silica sludge which has been separated. A proportioning device 15 supplies lime of milk of lime to stirrer vessel 14 while the same is supplied with water via conduit 16.

A separating unit (separator, decanter) 17, receives the contents of the stirrer vessel 14 and divides it so that filtrate is passed to a filtrate-collecting vessel 18 which via line 19 supplies the intermediate vessel 13 with black liquor from which silica has been removed. A conduit 20 for black liquor delivers such silica lean black liquor to evaporator 2. A vessel 21 for collecting sodium hydroxide solution feeds sodium hydroxide into line 20. A combustion furnace 22 receives precipitate from separating unit 17 and combusts the same. The combustion residue of molten material is removed via conduit 23.

DESCRIPTION OF THE PROCESS

Referring to the drawing, thin pulping liquor which is free from fibers and contains at least 8 to 12% dissolved solids is pumped from the pulp mill or from one of the first evaporating stages to the reactor 4 of the silica-removing plant. By means of a blower 10, flue gas is blown into the reactor 4. The temperature of the flue gas should exceed the dew point temperature in order to avoid a condensation of moisture.

By means of the pipe bend aerator, the liquor is intensely contacted with the flue gas. The exhaust gases escape through a mechanical foam skimmer (not shown) and then through the dome of the reaction vessel.

Treated liquor having the desired pH, e.g. 7,3 to 7,7 value leaves the reactor through a siphon and is delivered to a continuously operating unit 12 for separating the precipitates (centrifuge or sedimenting hopper+-centrifuge). When the precipitates have been separated from the liquor, the clear filtrate is delivered to an intermediate vessel 13.

The silica sludge which has been separated is pumped into a stirred vessel 14, which is also fed with water or quicklime or milk of lime from a suitable proportioning device 15 and used to wash the sludge. Lime is supplied at a rate which is about 1.5 to 2 times the rate which is stoichiometrically required in view of the sodium carbonate ($Na_2CO_3$) content of the sludge. After a predetermined residence time the sludge suspension is withdrawn and centrifuged on a separator or decanter 17.

The clear filtrate is supplied to a separate stacked tank 18 and from the latter is added to the clarified black liquor or used for a different purpose. The sludge which has been washed and dewatered is either disposed of as such or is supplied to a furnace 22 for an afterburning of the organic matter still contained in the sludge. If the combustion results in a molten material, this can be cooled and then granulated to form an ecologically satisfactory waste product, which can be disposed of or processed further. The proportions of $Na_2$, $SiO_2$ and CaO during the washing step are so adjusted that the melting point will be as low as possible.

Such combustion or melting may be effected, e.g., in a steam boiler which is fired with coal, gas or oil and which for that purpose is provided with a combustion chamber having a bottom which supports the molten material and is provided with means for tapping the molten material.

EXAMPLE

Spent pulping liquor obtained in a rice straw pulp mill is treated for a removal of silica in experiments carried out in a pilot plant in accordance with the above description.

1. Analysis of the spent liquor to be treated before said liquor enters the reaction vessel 4:

| | | |
|---|---|---|
| pH value | 11 | |
| Density | 1.04 | |
| Total solids content | 7.9% | |
| Organic solids content | 4.9% | |
| Total ash content | 3.0% | |
| $SiO_2$ content | 10.5 | grams per liter |

2. Analysis of the black liquor which has been treated with flue gas and is obtained after the reaction in reaction vessel 4. The quantities stated are based on a throughput of 1000 liters of liquor per hour:

| | | |
|---|---|---|
| Rate of spent liquor | | 1040 kg |
| Total solids content | 3.0% | 33.2 kg |
| Organic solids content | 4.8% | 49.9 kg |

-continued

| | | |
|---|---|---|
| Total ash content | 3.2% | 33.3 kg |
| $SiO_2$ content | | 10.5 kg |

3. Analysis of the clarified liquor 13 after the centrifugal separation in 12:

| | | |
|---|---|---|
| Quantity of spent liquor | 976.0 liters | 938.0 kg |
| Total solids content | 6.7% | 62.8 kg |
| Organic solids content | 4.5% | 42.2 kg |
| Total ash content | 2.2% | 20.6 kg |
| $SiO_2$ content | | 0.3 kg |

4. Analysis of the silica sludge separated in 12:

| | | |
|---|---|---|
| Quantity of sludge | | 102.0 kg |
| Total solids content | 20.0% | 20.4 kg |
| Organic solids content | 7.5% | 7.7 kg |
| Total ash content | 12.5% | 12.7 kg |
| $SiO_2$ content | | 10.2 kg |

The following values were obtained when the sludge had been slurried in 14 with the same weight of water and repeated centrifugal separation in 17:

5. Analysis of clear filtrate 18:

| | | |
|---|---|---|
| Quantity | | 139.0 kg |
| Total solids content | 4.1% | 5.7 kg |
| Organic solids content | 3.3% | 4.6 kg |
| Total ash content | 0.8% | 1.1 kg |
| $SiO_2$ content | | 0.04 kg |

6. Analysis of sludge separated in 17:

| | | |
|---|---|---|
| Quantity | | 63.0 kg |
| Total solids content | 23.3% | 14.7 kg |
| Organic solids content | 4.9% | 3.1 kg |
| Total ash content | 18.4% | 11.6 kg |
| $SiO_2$ | | 10.2 kg |

Calculation of losses per 1000 liters of black liquor which had been supplied:

7. Organic solids

| | |
|---|---|
| In the washed sludge | 3.1 kg |
| In the untreated black liquor | 51.0 kg |
| Loss: About 6.1% | |

8. Inorganic solids

| | |
|---|---|
| In the sludge (except $SiO_2$) | 1.4 kg |
| Theoretical content in untreated black liquor (except $SiO_2$) | 20.7 kg |
| Loss: 6.8% | |

The inorganic contents of the sludge obtained in the first centrifuging stage 12 contain some sodium carbonate ($Na_2CO_3$). The addition of milk of lime—$Ca(OH)_2$—through 15 to the washing water in 16 at a rate which is 1.5 to 2 times the stoichiometric equivalent of the sodium carbonate which is present results in the causticizing reaction $$Na_2CO_3 + Ca(OH)_2 \rightarrow CaCO_3 + 2NaOH$$

by which sodium hydroxide is formed, most of which is recovered from the clear filtrate.

What is claimed is:

1. In a continuous process of removing silica from spent pulping liquors which have been obtained by the alkaline digestion of annual plants, wherein said liquor is treated with $CO_2$-containing gas and the precipitated silica is separated, the improvement comprising:

(a) preconcentrating the spent liquor;

(b) treating the spent liquor by contacting the preconcentrated liquor with $CO_2$-containing gas, said $CO_2$-containing gas being supplied at a rate at 30 to 40 $m^3$ s.t.p. per $m^3$ of spent liquor thereby precipitating silica and sodium carbonate from the treated liquor;

(c) removing said precipitated silica and sodium carbonate from the treated liquor;

(d) diluting and washing the removed precipitated silica and sodium carbonate with water and causticizing said removed precipitated silica and sodium carbonate by an addition of lime or milk of lime, thereby obtaining a solid silica containing residue phase and a liquid phase;

(f) separating said solid and liquid phases; and, (g) combusting the silica-containing residue.

2. A process according to claim 1, wherein said $CO_2$-containing gas is a flue gas.

3. A process according to claim 1, wherein the spent liquor to be treated is pre-concentrated to a solids content of 8 to 30% by weight.

4. A process according to claim 1, wherein the spent liquor to be treated is preconcentrated to a solids content of 12 to 25% by weight.

5. A process according to claim 1, wherein the spent liquor which has been preconcentrated is contacted with the $CO_2$-containing gases in a jacket-heated reaction vessel by means of a pipe bend aerator.

6. A process according to claim 1, wherein the precipitate is removed from the treated liquor by sedimentation or centrifuging.

7. A process according to claim 1, wherein the silica-containing precipitate which has been removed is diluted and washed with water at a volume ratio of about 1:4–1.

8. A process according to claim 1, wherein the combustion is carried out so that inorganic constituents are melted and the resulting molten material is cooled and granulated.

9. A process according to claim 1, wherein proportions of $Na_2$, $SiO_2$ and CaO are adjusted during the washing of the precipitate and the causticization of the sodium carbonate content such that a eutectic mixture having the lowest possible melting point is obtained.

10. A process according to claim 1, wherein the quick lime or milk of lime is added in an amount of 1.5 to 2 times the stoichiometrically required amount to convert the sodium carbonate content of the silica-containing precipitate into sodium hydroxide.

11. A process according to claim 1, wherein the liquor treated is one obtained from alkaline digestion of bamboo, bagasse, reed, rice or straw.

12. A process according to claim 2, wherein said flue gas is produced by combusting organic components which are contained in said pulping liquor.

13. A process according to claim 1, wherein after precipitated silica is removed from said treated liquor, the treated liquor is concentrated in an indirect evaporator to a solids content of 60 to 65% and thereafter combusted.

14. A process according to claim 13, wherein the flue gas obtained as a result of said combustion is employed as said $CO_2$-containing gas.

15. A process according to claim 1, wherein a filtrate is obtained by a filtration of the washed precipitate, said filtrate is combined with the spent liquor from which the silica has been removed and recycling the resulting mixture to said preconcentrating step.

* * * * *

UNITED STATES PATENT AND TRADEMARK OFFICE

CERTIFICATE OF CORRECTION

PATENT NO. : 4,504,356

DATED : March 12, 1985

INVENTOR(S) : Jürgen Mülder et al

It is certified that error appears in the above-identified patent and that said Letters Patent is hereby corrected as shown below: On the title page;

| | |
|---|---|
| 1st page, under "Foreign Application Priority Data" | Delete "Jun. 3, 1982" and substitute -- March 6, 1982 -- |
| Col. 2, line 65 | Correct "adjusted" |

Signed and Sealed this

Ninth Day of July 1985

[SEAL]

*Attest:*

DONALD J. QUIGG

*Attesting Officer* *Acting Commissioner of Patents and Trademarks*